US006945216B2

(12) United States Patent
Trease

(10) Patent No.: US 6,945,216 B2
(45) Date of Patent: Sep. 20, 2005

(54) LUBRICATION DISTRIBUTION SYSTEM FOR ENGINE

(76) Inventor: John Trease, 11 Quick Street, Pascoe Vale, Melbourne, Victoria (AU) 3044

( * ) Notice: Subject to any disclaimer, the term of this patent is extended or adjusted under 35 U.S.C. 154(b) by 0 days.

(21) Appl. No.: 10/784,228

(22) Filed: Feb. 24, 2004

(65) Prior Publication Data

US 2005/0183689 A1 Aug. 25, 2005

(51) Int. Cl.[7] ..... F01M 1/00
(52) U.S. Cl. ..... 123/196 R; 184/26
(58) Field of Search ..... 123/196 R, 196 CP; 184/26, 27.1, 31, 37, 43

(56) References Cited

U.S. PATENT DOCUMENTS 5,769,036 A * 6/1998 Takahashi et al. ..... 123/41.33
5,924,400 A * 7/1999 Kobayashi ..... 123/196 R

* cited by examiner

*Primary Examiner*—Noah P. Kamen
*Assistant Examiner*—Katrina Harris
(74) *Attorney, Agent, or Firm*—Hoffman, Wasson & Gitler, P.C.

(57) ABSTRACT

The lubrication distribution system can be used whenever two chambers are separated by a wall with a source of lubrication in one chamber, a suction source in the other chamber and a pair of pathways between them for transporting oil. The oil distribution system for the internal combustion chamber uses appropriately placed ports and centrifugal force generated by a flywheel to provide lubrication for all moving parts in the engine. Oil is delivered from a sump to the cam chest. The cam chest is separated from the flywheel housing by a wall. A venturi port opening in the wall creates suction in the cam chest by virtue of the centrifugal force created by the flywheel. An air-oil mixture is circulated throughout the cam chest and through the venturi port opening. The oil mixture is circulated through the flywheel housing and returned to the cam chest through a second set of ports between the cam chest and flywheel housing.

18 Claims, 2 Drawing Sheets

LUBRICATION DISTRIBUTION SYSTEM FOR ENGINE

FIELD OF THE INVENTION

The invention relates to an internal combustion engine having an lubrication distribution system for lubricating the moving parts of the engine.

BACKGROUND OF THE INVENTION

Internal combustion engines consist of many moving parts, each made of metal. In the absence of lubrication, such as oil, the parts moving at high speeds will fuse to the parts of the engine they come in contact with, causing the engine to seize. To prevent seizure of the engine, lubrication, most commonly oil, is circulated throughout the engine to reduce friction between moving parts and allow metal parts to move at high speeds without damaging the engine.

Smaller, two stroke engines have oil mixed in with the fuel supply as a means for lubricating the internal parts. Bigger, four stroke engines, use oil pumps and circulation systems to provide lubrication to all moving parts. The continued functioning of the circulation system is imperative to assure the long life and proper operation of the engine.

Some smaller four stroke internal combustion engines, such as motorcycle engines, use a breather gear to regulate the flow of oil throughout the internal cavity of the engine. Wear and tear on the breather gear cannot be easily monitored, as the breather gear is a part internal to the engine and cannot be seen without partially dismantling the engine. The breather gear is relatively expensive but, over and above the cost of replacing a breather gear is the cost of the damage to the engine upon failure of the breather gear to provide adequate oil circulation. Upon complete failure of the breather gear, the engine may seize. Also, if part of the breather gear, such as a tooth, breaks loose from the gear, damage to the engine is caused by a loose metal part in the engine.

There is a need in the prior art for an oil circulation system having a minimal number of parts.

It is an object of the invention to provide an oil distribution system for an internal combustion engine.

It is another object of the invention to provide an oil distribution system using forces normally generated by an engine to distribute oil throughout the engine.

It is another object of the invention to provide an engine having a series of ports to circulate oil.

It is another object of the invention to provide an oil distribution system providing adequate lubrication with a minimum number of moving parts subject to failure.

These and other objects of the invention will become apparent to one of ordinary skill in the art after reading the disclosure of the invention.

SUMMARY OF THE INVENTION

The lubrication distribution system can be used whenever two chambers are separated by a wall with a source of lubrication, such as oil, in one chamber, a suction source in the other chamber and a pair of pathways between them for transporting oil. The oil distribution system for the internal combustion chamber uses appropriately placed ports and centrifugal force generated by a flywheel to provide lubrication for all moving parts in the engine. Oil is delivered from a sump to the cam chest. The cam chest is separated from the flywheel housing by a wall. A venturi port opening in the wall creates suction in the cam chest by virtue of the centrifugal force created by the flywheel. An air-oil mixture is circulated throughout the cam chest and through the venturi port opening. The oil mixture is circulated through the flywheel housing and returned to the cam chest through a second set of ports between the cam chest and flywheel housing.

DETAILED DESCRIPTION OF THE INVENTION

Figure 1:
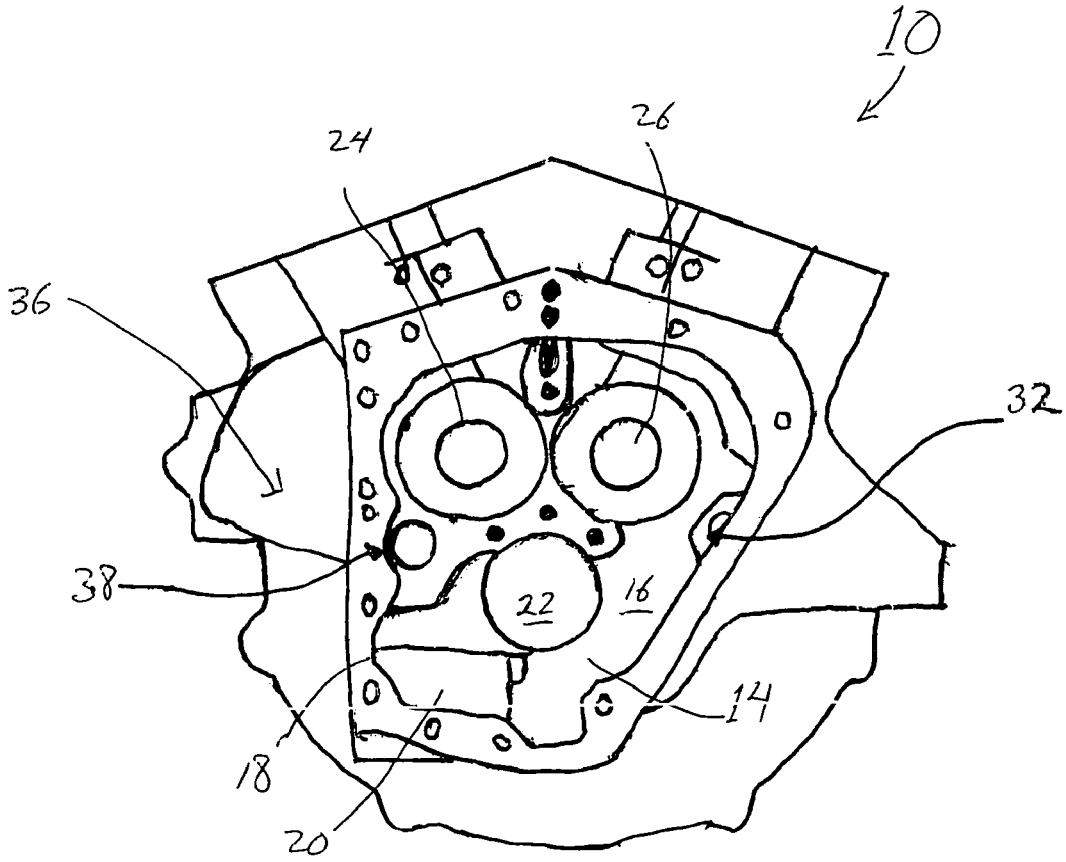
FIG. 1 is a left side view of the engine showing the cam chest.

The engine can be seen in FIG. 1, with parts removed so that the interior of the cam chest 14, defined by sidewall 18, is clearly seen. The cam chest has wall 16 with crankshaft apertures 22 and camshaft apertures 24, 26 extending therethrough to receive the crankshaft and camshafts, respectively. At the bottom of camshaft, oil conduit 20 delivers oil from the oil sump. Oil is delivered by a pump, as is conventional. On the right side of the cam chest is venturi port entrance 32.

On the left side of the cam chest 14 the return port 38 is positioned. The return port 38 is in fluid communication with cavity 36 formed in the left side of the engine.

Figure 2:
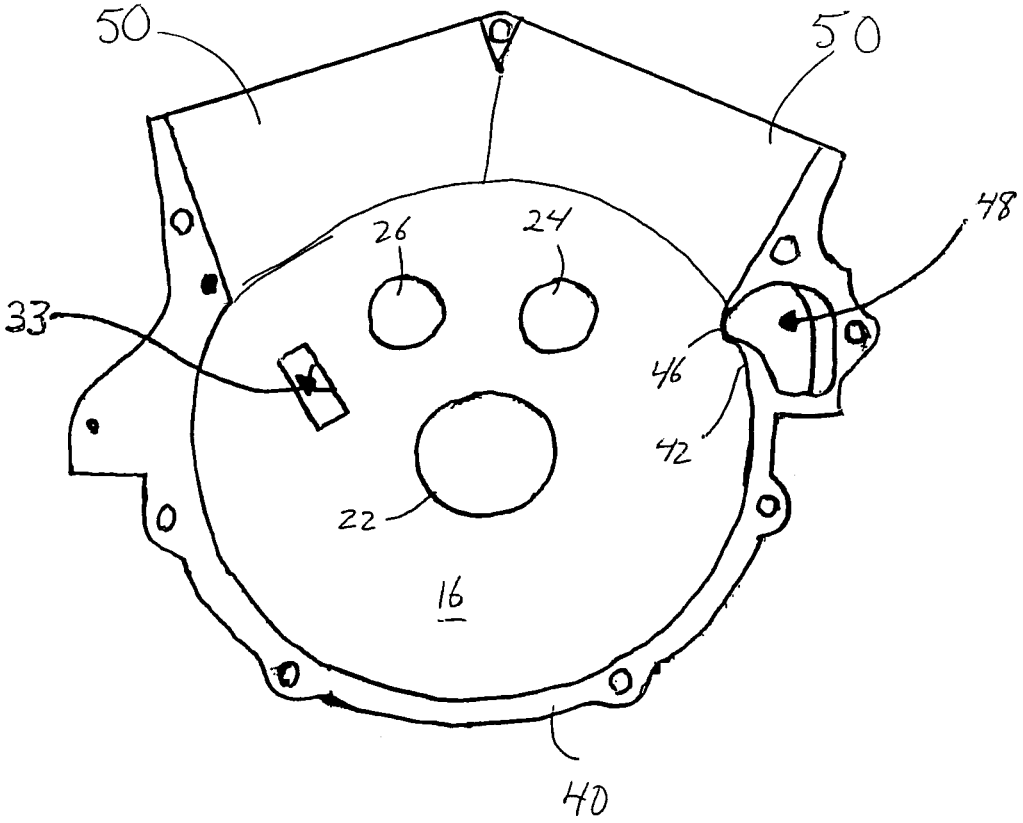
FIG. 2 is a right side view of the engine showing the flywheel housing.

FIG. 2 shows the right side of the engine. The right side is laterally spaced from the left side, depicted in FIG. 1. This side forms the flywheel housing with side wall 40 defining the housing and being substantially the same size and shape as the flywheel (not shown). The crankshaft aperture 22 and camshaft apertures 24, 26 in the wall 16 are clearly seen. Venturi port exit 33, positioned on the left side of the engine in this view, can be seen. As is obvious from this position, the venturi port exit 33 is larger than the venturi port entrance 32 increasing the suction and distribution effect of the port. Above the flywheel chamber and forming the top of the engine block is combustion chambers 50.

An opening 46 in the side wall 40 allows oil to exit the flywheel housing and enter port 48. To enhance the ability of the oil to enter the port 48, a scraper 42 is provided at the edge of the opening 46. Oil entering the port 48 continues into the cavity 36, previously described.

With the structure of the engine being described, the function of the oil distribution system will now be discussed. When the motor is in operation, the flywheel attached to the camshaft rotates within the flywheel housing. Oil is supplied to the bottom of the cam chest via conduit 22 from oil sump. The flywheel rotates in a clockwise direction, as seen in FIG. 2. Centrifugal force created by rotation of the flywheel causes a vacuum, drawing an air-oil mixture through the cam chest. Within the cam chest, the source of the suction is the venturi port entrance. For this reason, part of the air-oil mixture within the cam chest is drawn through venturi opening 32 and out of the venturi port exit 33 in the flywheel housing. The increasing cross-sectional shape of the venturi port enhances the vacuum effect.

Oil circulating within the flywheel housing 16 moves to the outer perimeter of the flywheel housing by nature of centrifugal force. Eventually, the oil is fed through opening 46 into port 48. Scraper 42, at the bottom edge of opening 46, increases the ability of oil to be fed into the port. The suction/scraping action controls the quantity of oil in both the cam chest and flywheel housing. In addition, the suction effect eliminates and controls positive air pressure build-up under pistons caused by the reciprocal motion of the pistons. Oil entering port 48 is channeled into cavity 36 and out return port 38. Return port 38 being a second source of oil in addition to conduit 20, in the cam chest further enhances the circulation of oil throughout the cam chest. Part of the oil returning through return port 38 is returned to the oil pump via a port or gallery. In this manner, oil is supplied to all moving parts in the cam chest and flywheel housing.

While the invention has been described for reference to a preferred embodiment, various additions and modifications would be apparent to one of ordinary skill in the art. Such variations and modifications do not depart from the scope of the invention. It is to be understood that the lubrication distribution system can be used with any type of machinery having two chambers, a lubrication source in one chamber, a suction source in the other and a pair of pathways to allow for the flow of lubricant.

What is claimed is:

1. A lubrication system, comprising
an engine block
a first chamber in said engine block,
a lubrication source in said first chamber,
a second chamber in said engine block laterally spaced from said first chamber,
a suction source in said second chamber,
a divider extending between said first chamber and said second chamber,
a first pathway between said first and second chamber transporting lubrication from said first to said second chamber,
a second pathway between said first and second chamber transporting lubrication from said second chamber to said first chamber.

2. The lubrication system of claim 1, wherein
said first pathway is located radially inwardly of said second pathway.

3. The lubrication system of claim 1, wherein
said first pathway is a venturi opening.

4. The lubrication system of claim 3, wherein
said second pathway has a chamber.

5. The lubrication system of claim 1, wherein
said second pathway has a chamber.

6. The lubrication system of claim 1, wherein
said lubricant source supplies oil.

7. The lubrication system of claim 1, wherein
said suction source is a rotating member.

8. The lubrication system of claim 7, wherein
said rotating member generates centrifugal force.

9. An internal combustion engine, comprising
an engine block,
a cam chest in said engine block,
a lubrication source in said cam chest,
a flywheel housing in said engine block,
a suction source in said flywheel housing,
a divider extending between said cam chest and flywheel housing,
a first pathway between said cam chest and flywheel housing for transporting lubrication, and
a second pathway between said cam chest and flywheel housing for transporting lubrication.

10. The internal combustion engine of claim 9, wherein said first pathway is located radially inwardly of said second pathway.

11. The internal combustion engine of claim 9, wherein said first pathway is a venturi opening.

12. The internal combustion engine of claim 11, wherein said second pathway has a chamber.

13. The internal combustion engine of claim 9, wherein said second pathway has a chamber.

14. The internal combustion engine of claim 9, wherein said lubricant source supplies oil.

15. The internal combustion engine of claim 9, wherein said suction source is a flywheel.

16. The internal combustion engine of claim 15, wherein said flywheel generates centrifugal force.

17. The lubrication system of claim 1, further comprising combustion chambers located above the first and second chambers.

18. The internal combustion engine of claim 9, further comprising combustion chambers located above the cam chest and flywheel housing.

* * * * *